US007409834B1

(12) United States Patent
Ganni

(10) Patent No.: US 7,409,834 B1
(45) **Date of Patent: *Aug. 12, 2008**

(54) HELIUM PROCESS CYCLE

(75) Inventor: Venkatarao Ganni, Yorktown, VA (US)

(73) Assignee: Jefferson Science Associates LLC, Newport News, VA (US)

( * ) Notice: Subject to any disclaimer, the term of this patent is extended or adjusted under 35 U.S.C. 154(b) by 368 days.

This patent is subject to a terminal disclaimer.

(21) Appl. No.: 11/267,730

(22) Filed: Nov. 4, 2005

Related U.S. Application Data

(63) Continuation-in-part of application No. 11/076,832, filed on Mar. 10, 2005, now Pat. No. 7,278,280.

(51) Int. Cl.
*F25J 1/00* (2006.01)

(52) U.S. Cl. ..... 62/606; 62/608

(58) Field of Classification Search ..... 62/606, 62/608

See application file for complete search history.

(56) References Cited

U.S. PATENT DOCUMENTS 3,389,565 A * 6/1968 Sahabettin ..... 62/608
3,611,740 A * 10/1971 Giger ..... 62/79
3,992,167 A * 11/1976 Beddome ..... 62/639
4,055,961 A * 11/1977 Admiraal ..... 62/48.2
4,161,107 A * 7/1979 Korsakov-Bogatkov et al. ..... 62/117
4,267,701 A * 5/1981 Toscano ..... 62/86
4,498,313 A * 2/1985 Hosoyama et al. ..... 62/608
4,606,744 A * 8/1986 Kundig ..... 62/608
4,666,481 A * 5/1987 Olson, Jr. ..... 62/608
4,765,813 A * 8/1988 Gaumer et al. ..... 62/606
5,265,426 A * 11/1993 Gistau-Baguer ..... 62/608
5,499,505 A * 3/1996 Gistau-Baguer ..... 62/608
6,170,290 B1 * 1/2001 Gistau-Baguer ..... 62/608
7,278,280 B1 * 10/2007 Ganni ..... 62/606

* cited by examiner

*Primary Examiner*—William C Doerrler

(57) ABSTRACT

A unique process cycle and apparatus design separates the consumer (cryogenic) load return flow from most of the recycle return flow of a refrigerator and/or liquefier process cycle. The refrigerator and/or liquefier process recycle return flow is recompressed by a multi-stage compressor set and the consumer load return flow is recompressed by an independent consumer load compressor set that maintains a desirable constant suction pressure using a consumer load bypass control valve and the consumer load return pressure control valve that controls the consumer load compressor's suction pressure. The discharge pressure of this consumer load compressor is thereby allowed to float at the intermediate pressure in between the first and second stage recycle compressor sets. Utilizing the unique gas management valve regulation, the unique process cycle and apparatus design in which the consumer load return flow is separate from the recycle return flow, the pressure ratios of each recycle compressor stage and all main pressures associated with the recycle return flow are allowed to vary naturally, thus providing a naturally regulated and balanced floating pressure process cycle that maintains optimal efficiency at design and off-design process cycle capacity and conditions automatically.

17 Claims, 3 Drawing Sheets

HELIUM PROCESS CYCLE

This application is a continuation-in-part of U.S. patent application Ser. No. 11/076,832 filed Mar. 10, 2005 which is now U.S. Pat. No. 7,278,280.

The United States of America may have certain rights to this invention under Management and Operating Contract No. DE-AC05-84ER 40150 from the Department of Energy.

FIELD OF THE INVENTION

The present invention relates to methods and apparatus for the production and refrigeration of a low temperature boiling point gas that maintains high operational efficiency at nominal design and off design operating capacity and conditions using a floating pressure process cycle.

BACKGROUND OF THE INVENTION

Traditional cryogenic helium refrigeration and liquefaction process cycles are designed at a specified maximum capacity operating point. In actual practice, however, the consumer load often varies depending upon the refrigeration and/or liquefaction consumer (heat) loads. Thus, traditional helium process cycle designs and equipment do not always provide the ability to reduce the refrigeration and liquefaction production while maintaining a high operational efficiency. During reduced consumer loads, traditional process cycle designs require maintaining design point operating pressures or allow varying only a limited number of operating pressures of some components. Thus, the actual operating process cycle (also known as the plant) utility requirements (electric power, liquid nitrogen and cooling water requirements) per unit of refrigeration and/or liquefaction delivered by such a traditional plant significantly increases at reduced consumer loads. Common methods of plant capacity reduction use pressure throttling valves, the addition of load using heaters and/or bypassing the cold and/or warm helium gas capacity produced by the components. Although these mechanisms reduce plant production, they have only limited effect on maintaining high plant efficiency. In fact, the implementation of these methods is analogous to driving an automobile with a fully depressed gas pedal while controlling the speed of the vehicle with the foot brake.

There thus exists a continuing need for a helium production and/or refrigeration cycle (sometimes referred to as process cycle herein) and apparatus that while allowing for reduced production maintains a high operating efficiency of a well designed process cycle operating at the required capacity.

OBJECT OF THE INVENTION

It is therefore an object of the present invention to provide a helium process cycle and apparatus that while allowing for designed and reduced production and/or refrigeration capacity maintains the high operating efficiency of a well designed plant operating at the required capacity.

SUMMARY OF THE INVENTION

According to the present invention there is provided an improved process cycle and apparatus for the implementation thereof comprising: a warm recycle compressor set, a warm consumer load return compressor, high pressure gas storage, a warm end pre-cooler stage and a cold end cooler stage. High pressure gas delivered by the warm recycle compressor set is cooled by the warm end pre-cooler and cold end cooler. The cold end cooler subdivides the high pressure flow to the recycle sub-cooler and the consumer load sub-cooler. Flow from the recycle sub-cooler is combined with the recycle return flow in the cold end cooler and warm end pre-cooler, so being warmed returns to the suction of the recycle compressor set. The consumer load return flow is delivered to the consumer load sub-cooler. Flow from the consumer load sub-cooler is warmed passing through the cold end cooler and warm end pre-cooler, returning to the suction of the consumer load compressor. Utilizing the unique gas management valve regulation, the unique process cycle and apparatus design in which the consumer load return flow is separate from the recycle return flow, the pressure ratios of each recycle compressor stage and all main pressures associated with the recycle flow are allowed to vary naturally, thus providing a naturally regulated and balanced floating pressure process cycle that maintains optimal efficiency at design and off-design process cycle capacity and conditions.

DETAILED DESCRIPTION

Figure 1:
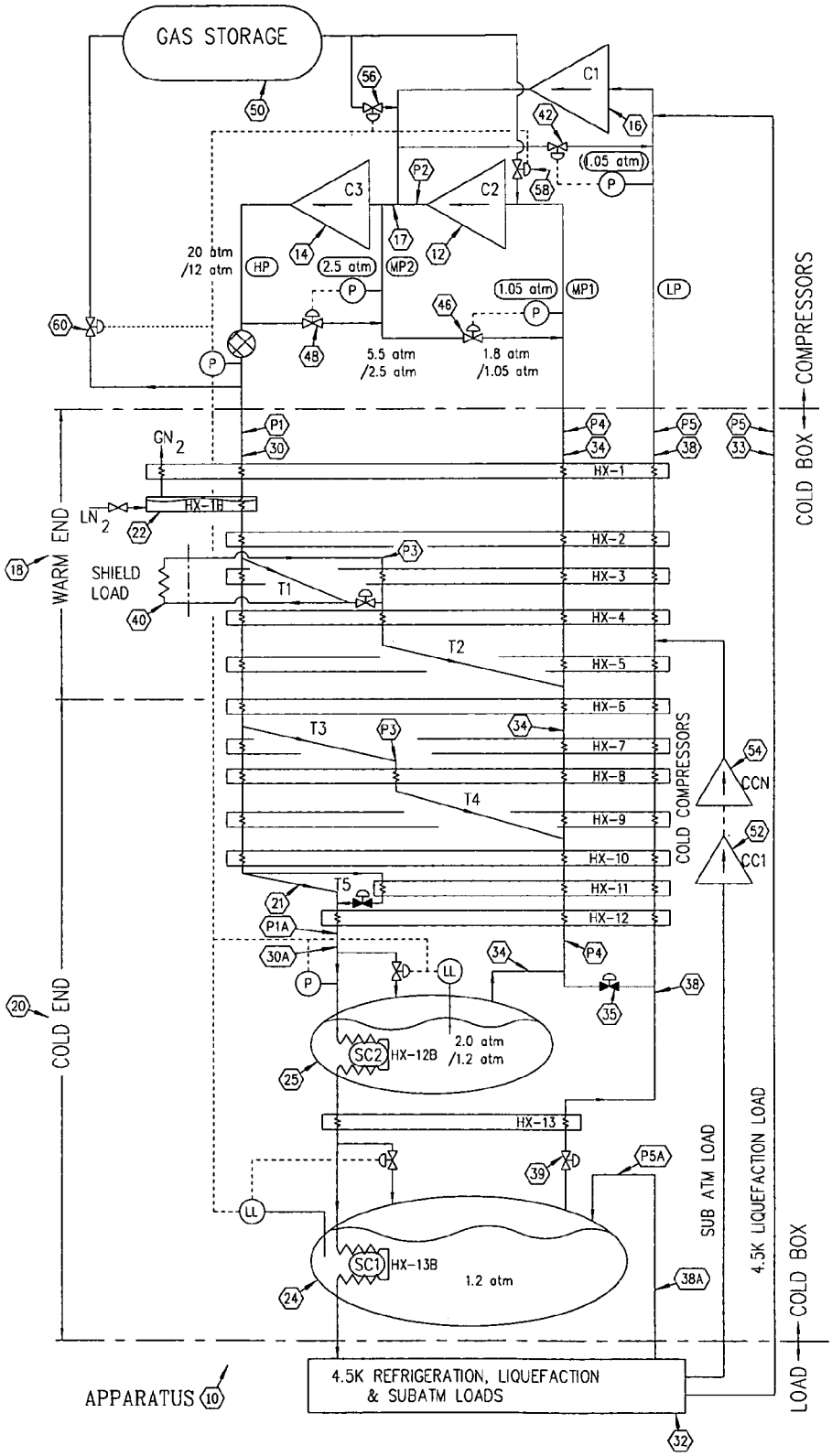
FIG. 1 is an overall schematic diagram of the helium process cycle and presented as apparatus 10 the present invention. It is also known as the base floating pressure process cycle.

Referring to FIG. 1 that is a flow schematic of the process cycle of the present invention, the apparatus 10 of the present invention comprises: three warm end compressor sets 12, 14 and 16, a warm end pre-cooler stage 18 and a cold end cooling stage 20. The compressor sets are comprised of a recycle compressor set made up of first and second stage recycle compressor sets 12 and 14 respectively in series and a consumer load return compressor set 16. Consumer load return compressor set 16 delivers an intermediate pressure level gas in between first and second stage recycle compressor sets 12 and 14.

Warm end pre-cooler 18 comprises a plurality of expansion stages, shown as T1 through T2 in FIG. 1, and may incorporate a liquid nitrogen ($LN_2$) pre-cooler 22. Cold end cooler 20 comprises a plurality of expansion stages, shown as T3 through T4 in FIG. 1, a consumer load expansion stage 21, a recycle sub-cooler 25 and a consumer load sub-cooler 24. It will be readily apparent to the skilled artisan that the number of warm and cold end expansion stages can be varied widely depending upon the consumer load or demand placed upon the process cycle and the compressor capacity available therein. As schematically represented in FIG. 1, within the apparatus 10 of the present invention, there are a plurality of pressure levels present, all of which are naturally maintained in balance during the operation of the process cycle and apparatus of the present invention. The plurality of pressure levels present in apparatus 10 is as follows: a high pressure level $P_1$ flowing in line 30 from second stage recycle compressor set 14 in the direction of consumer load 32; a first intermediate pressure level $P_2$ in line 17 between recycle compressor sets 12 and 14; and a plurality of second intermediate pressures $P_3$ between the expansion stages flowing from line 30 to a low pressure recycle return pressure level $P_4$ in line 34. In some configurations in the warm end pre-cooler 18 the flow from line 30 to the intermediate pressure $P_3$ between expansion stages may become a medium pressure recycle return, shown as line 17 in FIGS. 5 through 7, to the intermediate pressure $P_2$ in between first and second stage recycle compressor sets. The high pressure level $P_1$ reduces to $P_{1A}$ as the flow is expanded across the consumer load expansion stage 21 into line 30A, also known as the high pressure level. The high pressure level $P_{1A}$ in line 30A is usually maintained at a fixed set pressure to satisfy the consumer load requirements. Low pressure recycle return pressure level $P_4$ is the pressure in line 34 that flows from recycle sub-cooler 25 back to the suction of first stage recycle compressor set 12. The consumer load return pressure $P_{5A}$ in line 38A flows into the consumer load sub-cooler 24. From the consumer load sub-cooler 24, through the consumer load return pressure control valve 39 and by way of heat exchange through the cold end cooler 20 and warm end pre-cooler 18, the consumer load return in line 38 flows to the suction of consumer load return compressor set 16. Valve 23 in FIGS. 3 and 4 allows connection between the P3 stream and the P1*a* stream to improve the high pressure flow capacity to the load 32. The capacity optimization valve 35 shown in FIGS. 1, 2, 3 and 4 serves to improve the sharing of compressor capacity between first stage recycle compressor 12 and consumer load return compressor 16.

Figure 5:
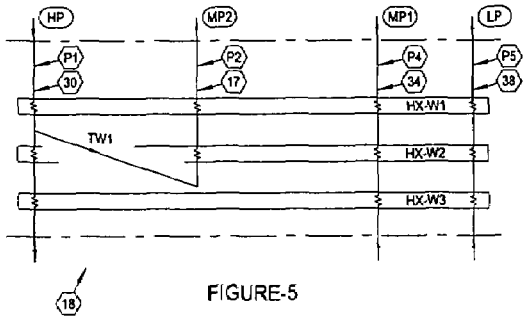
FIGS. 5 through 8 depict four additional warm end 18 process cycle configurations to which the process cycle and apparatus of the present invention are applicable.
Figure 6:
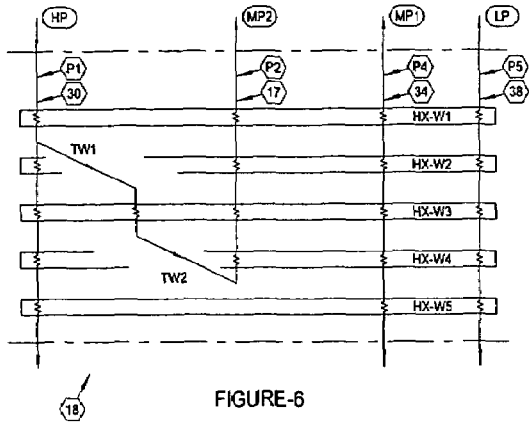
Figure 7:
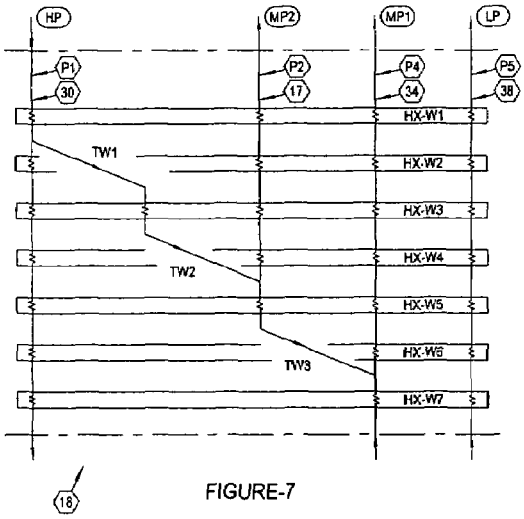
Figure 8:
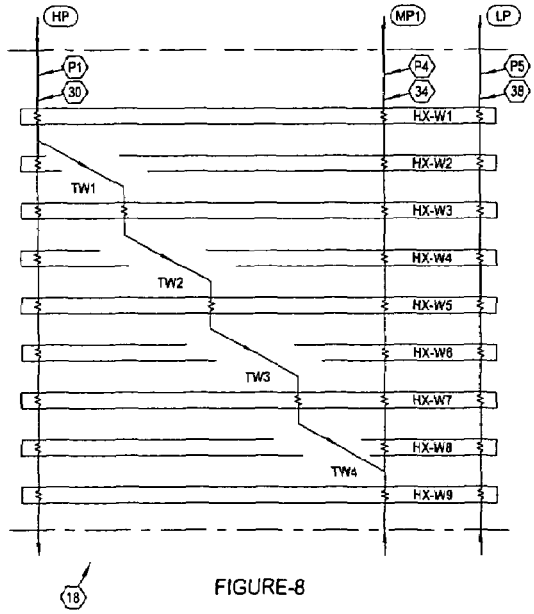

In operation, high pressure gas at pressure $P_1$ from the recycle compressor sets 12 and 14 is cooled in the warm end pre-cooler 18. High pressure gas flow in line 30 entering the warm end pre-cooler may be cooled by $LN_2$. One or more sub-flows are cooled by expansion and heat exchange to the low pressure recycle return pressure $P_4$ in line 34 or, as shown in FIGS. 5 through 7, to the medium pressure recycle return pressure $P_3$ (which is equal to $P_2$) in line 17. The low pressure recycle return in line 34 is returned as warm gas via heat exchange in the warm-end pre-cooler and cold end cooler to the suction of the first stage recycle compressor set 12. The medium pressure recycle return in line 17, as shown in FIGS. 5 through 7, is returned as warm gas via heat exchange in the warm end pre-cooler to the suction of the second stage recycle compressor set 14. Another sub-flow may go to an optional consumer shielding load 40. The high pressure gas at $P_1$ in line 30 is then further cooled by the cold end cooler 20. One sub-flow is cooled by expansion and heat exchange to the low pressure recycle return pressure $P_4$ in line 34. The remaining high pressure $P_1$ gas flow in line 30 is then further cooled by consumer load expansion stage 21 to pressure $P_{1A}$ in line 30A, further heat exchange and finally by the recycle sub-cooler 25 and consumer load sub-cooler 24 from whence it is applied to the consumer load 32. Any one of the expansion stages in the cold end cooler 20, or a sub-flow of high pressure gas in line 30A from the consumer load expansion stage 21 may supply the flow to the recycle sub-cooler 25. The flow to the consumer load sub-cooler 24 is supplied either by a sub-flow from the high pressure gas in line 30A in the cold end cooler or from the recycle sub-cooler 25, with or without heat exchange. The low pressure consumer load return $P_{5A}$ in line 38A returns flow from consumer load 32 to consumer load sub-cooler 24. The low pressure consumer load return flow at $P_5$ is warmed by heat exchange in the cold end cooler 20 and warm end pre-cooler 18, finally returning to the suction of the consumer load return compressor set 16.

The process cycle and apparatus design described herein are unique in that they separate the consumer load return flow in line 38A and 38 from most of the process cycle recycle flow, shown as line 34 in FIGS. 1 through 4 and as lines 34 and 17 in FIGS. 5 through 7. The recycle return flow is recompressed by a two stage compression system (12 and 14), as depicted in FIG. 1, and the consumer load return flow in line 38A and 38 is recompressed by an independent compressor set 16. Compressor set 16 maintains a desirable constant suction pressure (for example, 1.05 atmospheres in the embodiment depicted in FIG. 1) for nominal 4.5K loads and/or the discharge pressure of sub atmospheric cold compressors 52 through 54. This is accomplished using a bypass control valve 42 around compressor set 16 that regulates the consumer load compressor suction pressure. The flow in line 33 at the consumer load return pressure $P_5$ represents the liquefaction load returned (warm) from the consumer load 32 to the consumer load compressor set 16. The discharge pressure of compressor set 16 is thereby allowed to float with the intermediate pressure $P_2$ in between compressor sets 12 and 14.

Because the consumer load return flow in lines 38A and 38 is separated from the recycle return, shown as line 34 in FIGS. 1 through 4 and lines 34 and 17 in FIGS. 5 through 7, this process cycle is unique by allowing the pressure ratios of the two stage recycle compressor sets 12 and 14 and all main process line pressures ($P_1$, $P_2$, $P_3$ and $P_4$) associated with the recycle flow of the process cycle to vary naturally, thus providing a floating pressure system. This is depicted in FIG. 1, and is known as the base floating pressure process cycle. Bypass control valves 46 and 48 around compressors 12 and 14, respectively, are only provided for extreme off design operation to prevent sub atmospheric suction pressures and to maintain minimum compressor discharge oil removal pressures. These off design conditions may be caused by a consumer load reduction, shutdown of the expanders and/or the loss of return flows.

The implementation of the gas management regulation configuration, shown in the FIG. 1, is unique and contributes to allowing the floating pressure system to follow the consumer load demands placed on the process cycle or apparatus 10 while maintaining high system efficiency. The fairly high efficiency of the process cycle is realized by allowing the compressor sets 12 and 14 and the expanders (in warm end pre cooler 18 and cold end cooler 20) to operate close to their natural occurring optimal pressure ratios and efficiencies for the varying consumer load demands and conditions.

Under normal consumer load operation the suction pressures of compressor sets 12 and 14 will each naturally vary (without the need for regulation) between a nominal minimum and maximum preset value; for example, 1.05 to 1.8 atmospheres (for $P_4$) and 2.5 to 5.5 atmospheres (for $P_2$), respectively, for typical consumer load. Although the consumer load varies, sub-coolers 24 and 25 provide a constant supply pressure and temperature flow to the consumer load 32. The pressure within the recycle sub-cooler 25 will vary naturally; for example 1.2 to 2.0 atmospheres as the suction pressure $P_4$ of compressor set 12 varies. The suction to the consumer load compressor set 16 is regulated between a nominal minimum and maximum by the capacity optimization valve 35, bypass valve 42 and consumer load return pressure control valve 39, respectively.

At a given operating condition, the size of the change in the consumer load 32 is indicated by the rate of change in the liquid levels within sub-coolers 25 and/or 24. With an increasing consumer load 32 demand, the liquid level within the sub-coolers 25 and/or 24 will decrease. This is an indication that the gas charge of the process cycle must be increased to handle the additional consumer load 32. Additional helium gas is brought into the suction of compressor sets 14 and/or 12 from gas storage 50 using the mass-in valves 56 and/or 58 until there is enough discharge pressure from compressor set 14 to maintain the sub-coolers 25 and/or 24 at their liquid levels between the desired minimum and maximum liquid levels corresponding to the consumer load 32 demand. Another indication of the current consumer load's 32 effect on the present operating condition of the process cycle may be used instead of the sub-coolers 25 and/or 24 liquid level. Similarly, if the liquid level in the sub-coolers 25 and/or 24 are increasing it is an indication that the required consumer load 32 has decreased. In this case excessive gas charge is returned from compressor set 14 discharge to gas storage 50 using the mass-out valve 60 until the liquid levels in the sub-coolers 25 and/or 24 are again stable at their liquid levels between the desired minimum and maximum liquid levels corresponding to the consumer load 32 demand. Another indication of the current consumer load's 32 effect on the present operating condition of the process cycle may be used instead of the sub-coolers 25 and/or 24 liquid level. Nominal variations of the compressor set 14 discharge pressure $P_1$ may vary, for example, from 12 to 20 atmospheres in the embodiment depicted in the accompanying Figures. Typically the relationship between the recycle compressor set 14 discharge (high pressure gas level $P_1$), which is directly affected by the mass-out valve 60 and indirectly affected by the mass-in valves 56 and/or 58, is such that as the liquid level decreases, the high pressure gas level $P_1$ set point increases. The sub-coolers 25 and/or 24 liquid level serves only as a current indication of the effect of the consumer load 32 on the present operating process cycle. Additionally, typically the high pressure gas level $P_{1A}$ in line 30A may be regulated by the flow to the recycle sub-cooler 25; and, the liquid level in the consumer load sub-cooler 24 may be regulated by the sub-flow supply to the consumer load sub-cooler 24. There are other variations that accomplish the same spirit and intent which are readily apparent to the artisan, depending on the process cycle specific needs and actual operating behavior of the plant.

Should an expander shut down and/or a return flow be lost, the bypass valves 42, 46 and 48 around compressor sets 16, 12 and 14 begin to regulate at their default set pressures (for example, 1.05 atmospheres, 1.05 atmospheres and 2.5 atmospheres, respectively).

For operating conditions where the flow from the consumer load return in line 38A and 38 exceeds the consumer load return compressors set 16 capacity, the capacity optimization valve 35 will allow the first stage recycle compressor set 12 to assist the consumer load compressor set 16 with the consumer load return flow. Also, for operating conditions where the consumer load return flow in line 38 is less than the consumer load return compressors set 16 capacity, the capacity optimization valve 35 will allow the consumer load return compressor set 16 to assist the first stage recycle compressor set 12 with the recycle return flow.

For operating conditions where the flow from the consumer load return 38A exceeds the consumer load return compressor set 16 capacity, the consumer load return pressure control valve 39 may be used to regulate the rate at which the consumer load return flow in line 38A is directed into line 38 to be processed by the consumer load compressor set 16.

The approximate system pressures for the maximum (100 percent) and the minimum (approximately 30 percent of the maximum) capacity are shown in FIG. 1. The process cycle can be further optimized for different combinations of loads required by a consumer.

This new process cycle and associated apparatus maintain high plant operational efficiencies at full and greatly reduced plant capacities automatically. The new process cycle provides a substantial increase in efficiency for nominal 4.5K and 2K refrigeration and/or liquefaction consumer loads over traditional process cycle design efficiencies for a given number of pre-cooling/cooling expansion stages, heat exchange and warm helium compression stages.

As compared to any other process cycle that exists today, this process cycle and associated apparatus 10 described herein can support consumer loads from 100 percent to about 30 percent of the maximum design capacity, at the highest possible efficiency as compared to the full capacity design Carnot efficiency. The process cycle may be designed to continuously operate all the way to zero percent of full load by stopping certain expansion stages. Utilizing the unique gas management valve regulation, this new process cycle will automatically follow the consumer load capacity requirements. The new process cycle is also easily adaptable and applicable to various nominal 4.5K refrigeration and/or liquefaction consumer loads, consumer shield refrigeration loads (which can be arranged across any or multiple expanders) and consumer sub-atmospheric loads that use cold compressors and/or warm vacuum pumps. The new process cycle can also be constructed with or without $LN_2$ pre-cooling.

Figure 2:
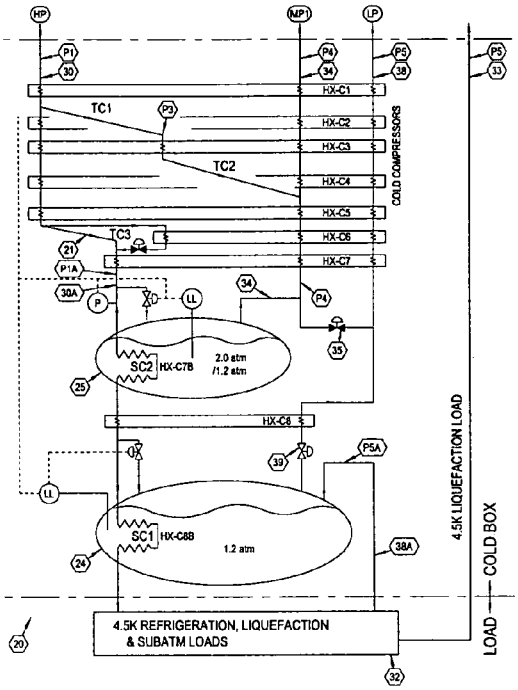
FIGS. 2 through 4 depict three additional cold end 20 process cycle configurations to which the process cycle and apparatus of the present invention are applicable.
Figure 3:
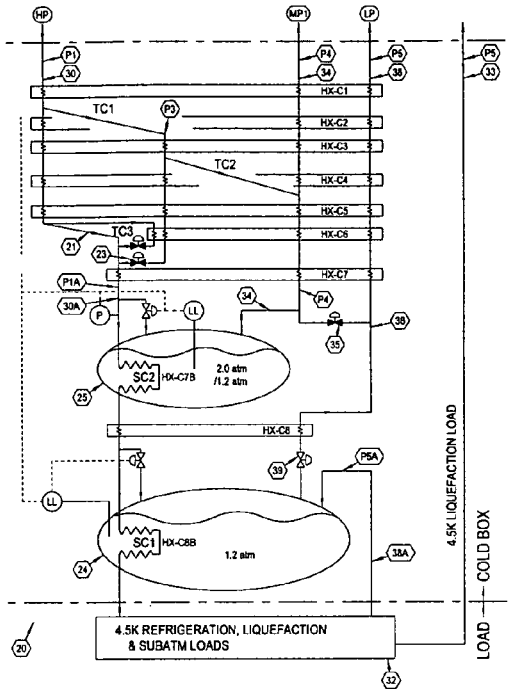
Figure 4:
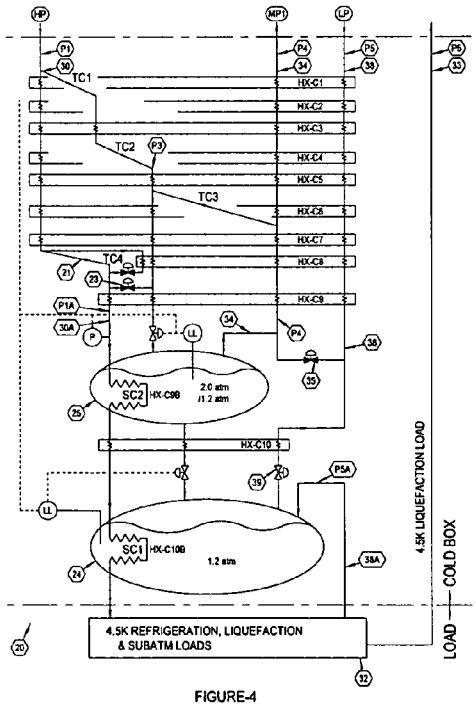

As will be apparent to the skilled artisan, a variety of cold end cooler 20 and warm end pre-cooler 18 process cycle configurations can be accommodated within the parameters described hereinabove. These additional configurations are substitutable to the warm end pre-cooler 18 and the cold end cooler 20 in FIG. 1. Three such additional cold end cooler process cycle configurations are schematically depicted in FIGS. 2 through 4 and four such additional warm end pre-cooler process cycle configurations are schematically depicted in FIGS. 5 through 8. Each of the depicted configurations allows for specific consumer load application combinations when used with the base floating pressure process cycle schematically depicted in FIG. 1 and described herein.

Although the various mechanisms and systems for detecting liquid levels and gas pressures, controlling the opening and closing of valves etc. are not described in detail herein, such mechanisms and systems are well known to those skilled in the production and handling of low boiling gases and hence no detailed description thereof is required herein to permit the successful practice of the invention in accordance with the disclosure hereof.

Similarly, although the description herein is in the context of a helium refrigeration and/or liquefaction process cycle, it will be readily apparent to the skilled artisan that the inventive concepts described herein are equally applicable to other gas refrigeration and/or liquefaction process cycles such as those charged with hydrogen, neon or some other low temperature boiling gas.

As the invention has been described, it will be apparent to those skilled in the art that the same may be varied in many ways without departing from the intended spirit and scope of the invention, and any and all such modifications are intended to be included within the scope of the appended claims.

What is claimed is:

1. An apparatus for the production and/or refrigeration of a low temperature boiling point gas comprising:

A) a recycle compressor set comprising in series a first stage recycle compressor set and a second stage recycle compressor set each having a suction and a discharge and delivering high pressure coolant at a floating high pressure, receiving recycle return coolant at a floating lower pressure;

B) a consumer load return compressor set having a suction and a discharge delivering coolant at an intermediate floating pressure level at a point in between the first and second stage recycle compressor sets and receiving low pressure consumer returned coolant;

C) a warm end pre-cooler comprising an $LN_2$ pre-cooler and/or a plurality of expansion stages with heat exchange receiving high pressure coolant from the recycle compressor set, delivering one or more portions of the high pressure coolant through a one or more expansion stages with heat exchange to the recycle return, and the remaining portion of high pressure coolant to a cold end cooler;

D) the cold end cooler receiving coolant from the warm end pre-cooler, delivering one or more portions of the high pressure coolant through a one or more cold end cooler expansion stages with heat exchange to a either the recycle return or the recycle sub-cooler, comprising a plurality of expansion stages with heat exchange, a consumer load expansion stage, a recycle sub-cooler and a consumer load sub-cooler;

E) a recycle return in the cold end cooler and warm end pre-cooler, receiving high pressure coolant through a plurality of expansion stages with heat exchange, delivering warmed coolant via heat exchange with the cold end cooler and warm end pre-cooler to the suction of the recycle compressor set;

F) a recycle sub-cooler receiving coolant from one or more of the cold end cooler expansion stages with heat exchange or from the cooled high pressure coolant flow from the consumer expansion stage, returning recycle return coolant and providing further cooling of high pressure coolant being delivered to the consumer load;

G) a consumer load sub-cooler receiving coolant from either the recycle sub-cooler or from the high pressure coolant cooled by the recycle sub-cooler, delivering high pressure coolant to a consumer load, receiving low pressure consumer returned coolant from the consumer load;

H) a separate low pressure consumer return, receiving coolant from the consumer load sub-cooler, delivering warmed coolant via heat exchange with the cold end cooler and warm end pre-cooler to the suction of the consumer load return compressor set;

I) a coolant gas storage device for the storage, removal and addition of gas coolant to the cooling cycle as required at the first or second stage recycle compressor sets via coolant supply lines located intermediate the gas storage device and the first and second stage recycle compressor sets.

2. The apparatus of claim 1 further including a first stage recycle bypass valve located intermediate the first stage recycle compressor suction and discharge for bypassing flow from the discharge to the suction of first stage recycle compressor set should pressure to the first recycle return suction fall below a preset minimum.

3. The apparatus of claim 2 further including a consumer load compressor bypass valve located intermediate the discharge of the first stage recycle compressor set and the suction of the consumer load compressor for bypassing flow from the discharge to the suction of the consumer load compressor set should the pressure at the suction of the consumer load compressor set deviate from the desired set point.

4. The apparatus of claim 3 further including a second stage recycle compressor bypass valve located intermediate the second stage recycle compressor set discharge and suction for bypassing flow from the discharge to the suction of the second stage recycle compressor set should the pressure in between the first and second stage recycle compressor set fall below a preset minimum.

5. The apparatus of claim 4 further including a recycle return mass-in valve located intermediate the gas storage device and the suction of the first stage recycle compressor set for directing flow from the gas storage device to the suction of the first stage recycle compressor set based upon the level of liquid in either or both of the recycle sub-cooler and the consumer load sub-cooler, or based upon another equivalent indication of the current consumer load demand on the present operating condition of the process cycle.

6. The apparatus of claim 5 further including a mass-in valve located intermediate the gas storage device and the suction of the second stage recycle compressor set for directing flow from the gas storage device to the suction of the second stage recycle compressor set based upon the liquid level in either or both of the recycle sub-cooler and the consumer load sub-cooler, or based upon another equivalent indication of the current consumer load demand on the present operating condition of the process cycle.

7. The apparatus of claim 6 further including a mass-out valve located intermediate the discharge of the second stage recycle compressor set and the gas storage device for directing flow from the discharge of the second stage recycle compressor set to the gas storage device based upon the liquid level in either or both of the recycle sub-cooler and the consumer load sub-cooler, or based upon another equivalent indication of the current consumer load demand on the present operating condition of the process cycle.

8. The apparatus of claim 7 further including a capacity optimization valve for directing flow from either the consumer load return to the recycle return or vice versa.

9. The apparatus of claim 8 further including a consumer load return pressure control valve for regulating the low pressure consumer load return flow to the consumer load compressor set and to the recycle compressor set.

10. A method for the production and/or refrigeration of a low temperature boiling gas comprising:

A) charging a low boiling gas production and/or refrigeration system from a coolant storage device with a low boiling gas using a compressor set comprising a first stage recycle compressor set, a second stage recycle compressor set, and a consumer load compressor set, each of the compressors having a discharge and a suction end;

B) compressing the coolant to a high pressure in the compressor sets;

C) cooling the high pressure coolant by transfer through a warm end pre-cooler comprising an $LN_2$ pre-cooler and/or a plurality of expansion stages with heat exchange;

D) transferring a single or multiple portions of the high pressure coolant in the warm-end pre-cooler via expansion stages with heat exchange providing cooling, and thence to a recycle return;

E) transferring coolant to the recycle return in the warm end pre-cooler for warming by heat exchange, and thence to the suction of the recycle compressor set via the recycle return;

F) further cooling the high pressure coolant by transfer through a cold end cooler comprising a plurality of expansion stages with heat exchange, a consumer load expansion stage, a recycle sub-cooler and a consumer load sub-cooler;

G) transferring a single or multiple portions of the high pressure coolant in the cold-end cooler via expansion stages with heat exchange providing cooling, and thence to a recycle return or to the recycle sub-cooler;

H) transferring coolant delivered to the recycle return in the cold end cooler for warming by heat exchange with the cold end cooler and warm end pre-cooler and thence to the suction of the recycle compressor set;

I) further cooling of the high pressure coolant through a consumer load expansion stage with heat exchange;

J) transferring a portion of either the high pressure coolant leaving the consumer expansion stage or a portion of the coolant cooled via one or more expansion stages with heat exchange in the cold end cooler to a recycle sub-cooler as a coolant;

K) transferring a portion of the coolant in the recycle sub-cooler to a recycle return;

L) transferring coolant from the recycle sub-cooler delivered to the recycle return in the cold end cooler for warming by heat exchange with the cold end cooler and warm end pre-cooler and thence to the suction of recycle compressor set;

M) transferring of a portion of the coolant from the recycle sub-cooler or a portion of the high pressure coolant cooled by the recycle sub-cooler to a consumer load sub-cooler as a coolant;

N) further cooling of the high pressure coolant through the consumer load sub-cooler and delivering the high pressure coolant to a consumer load to cool the consumer load, and produce consumer load returned coolant;

O) transferring the consumer load returned coolant to the consumer load sub-cooler;

P) transferring the consumer load returned coolant, from the consumer load sub-cooler to the cold end cooler and warm end pre-cooler for warming and thence to the suction of a consumer load compressor set via a separate low pressure consumer load return; and Q) re-introducing the consumer load return coolant to the process cycle by compression in the consumer load compressor set and delivery to a point between the first and second stage recycle compressor sets.

11. The method of claim 10 further comprising: detecting the level of liquid coolant in the recycle sub-cooler and/or the consumer load sub-cooler or some other indication reflecting the current consumer load demand's effect on the present operating condition of the system, and opening or closing mass-in and mass-out valves located between the gas storage device and the first and second recycle compressor sets to charge or depressurize the system, allowing the system floating pressures to compensate for an increase or decrease in the consumer load.

12. The method of claim 11 further comprising: opening a first stage recycle bypass valves located intermediate the first stage recycle compressor set suction and discharge to bypass flow of coolant from between the first and second stage recycle compressor sets to the suction end of the first stage recycle compressor set in the event that pressure in the recycle return feeding the first stage recycle compressor set falls below a preset minimum.

13. The method of claim 12 further comprising: opening a consumer load compressor bypass valve located intermediate the consumer load compressor suction and discharge to bypass flow of coolant from the discharge of the consumer load compressor set to the suction of the consumer load compressor set to maintain a desired consumer load return pressure.

14. The method of claim 13 further comprising: opening a capacity optimization valve located intermediate the consumer load compressor suction and the first stage recycle compressor suction to flow of coolant to maintain a desired consumer load compressor capacity.

15. The method of claim 14 further comprising: opening a second stage recycle compressor bypass valve located intermediate the second stage recycle compressor suction and discharge to bypass flow of coolant from the discharge of the second stage recycle compressor set to the suction of the second stage recycle compressor set in the event that pressure at the suction of the second stage recycle compressor set falls below a preset minimum.

16. The method of claim 15 further comprising: opening a naturally operating capacity equalization valve to direct warm flow from the consumer load return to the recycle return.

17. The method of claim 16 further comprising: opening or closing a consumer load return pressure control valve, thereby regulating consumer load return to the compressor sets.

* * * * *